US005503309A

United States Patent [19]

Oder et al.

[11] Patent Number: 5,503,309

[45] Date of Patent: Apr. 2, 1996

[54] TOGGLE DISPENSING CLOSURE WHEREIN THE TOGGLE IS ATTACHED TO THE CLOSURE BY A PAIR OF OPPOSING SLOTS

[75] Inventors: Reuben E. Oder, Union, Ky.; David M. Groh, Loveland, Ohio

[73] Assignee: The Procter and Gamble Co., Cincinnati, Ohio

[21] Appl. No.: 255,278

[22] Filed: Jun. 8, 1994

[51] Int. Cl.[6] ..... B67D 3/00

[52] U.S. Cl. ..... 222/534; 222/556

[58] Field of Search ..... 222/533, 534, 222/545, 556; 220/337, 338; 215/235

[56] References Cited

U.S. PATENT DOCUMENTS

| | | | |
|---|---|---|---|
| 3,516,581 | 6/1970 | Micallef | 222/529 |
| 4,487,342 | 12/1984 | Shy | 222/481.5 |
| 4,666,068 | 5/1987 | Bush | 222/546 |
| 4,776,501 | 10/1988 | Ostrowsky | 222/517 |
| 5,065,911 | 11/1991 | Rohr et al. | 222/517 |
| 5,192,005 | 3/1993 | Zimmerman | 222/148 |
| 5,242,079 | 9/1993 | Stephens et al. | 220/705 |
| 5,370,284 | 12/1994 | Dirksing | 222/534 |

*Primary Examiner*—Gregory L. Huson
*Attorney, Agent, or Firm*—Michael J. D'Amelio; Dean L. Garner; Michael E. Hilton

[57] ABSTRACT

In accordance with the present invention there is provided an injection molded toggle dispensing closure for a package for dispensing a product. The dispensing closure includes a cap formed from a housing. The housing has a top wall and a peripheral wall surrounding and attached to the top wall so as to form a cavity. The top wall includes a lower recessed portion surrounded by an edge wall. The lower recessed portion has an aperture extending therethrough into the cavity. The edge wall has two opposing slots extending into the cavity. The slots extend upwardly from the recessed lower portion along the edge wall. The cap further including a device for attaching itself to a package. The closure further includes a toggle. The toggle has an upper wall and opposing front and back walls and opposing side walls all of which surround and are attached to the upper wall. The side walls each have an outwardly extending tab which is inserted into the opposing slots on the edge wall so as to retain the toggle onto said cap, thereby allowing the toggle to pivot around the slots. The front wall has a dispensing opening which communicates with the aperture on the recessed lower portion so as dispense the product.

6 Claims, 5 Drawing Sheets

TOGGLE DISPENSING CLOSURE WHEREIN THE TOGGLE IS ATTACHED TO THE CLOSURE BY A PAIR OF OPPOSING SLOTS

FIELD OF THE INVENTION

The present invention relates to dispensing packages. The present invention has further relation to packages having toggle dispensing closures. The present invention has even further relation to such packages that are manufactured by injection molding.

BACKGROUND OF THE INVENTION

Toggle dispensing closures have been used on dispensing packages for many years. One such closure is described in U.S. Pat. No. 3,516,581 issued to Micallef on Jun. 23, 1970, which is hereby incorporated herein by reference. Typically the closure is formed from a cap member, to seal the top of the package, and a toggle closure secured onto the top of the cap. The toggle is so that by pressing down on one end of the toggle, the other end moves up so as to expose a dispensing opening which communicates with the interior of the package so as to dispense the product, typically a liquid product. Thereafter, in order to close the toggle, the end of the toggle having the dispensing opening therein is pressed down so as to return the toggle to its original closed position.

Most toggles, including the one disclosed in the Micallef reference, are retained onto the package through use of semi-spherical pins or projections extending from the sides of the toggle. These pins snap into a pair of corresponding semispherical indentations on the cap so as to retain the toggle and allow it to pivot. However, the semi-spherical snap-on arrangement described above does not securely retain the toggle onto the cap, and can become dislodged. One type of toggle closure which does not have the toggle attached to the cap by way of semi-spherical indentations is described in U.S. Pat. No. 5,242,079 issued to Stephens et al. on Sep. 7, 1993, which is hereby incorporated herein by reference. As seen in FIG. 4 of that reference, the toggle appears to be retained onto the closure through the use of apertures on the cap which cooperate with journals on the toggle.

However, when both of these types of closures are manufactured using injection molding, the semi-spherical indentations or apertures on the cap are typically created through the use of a complex mechanism, such as a core pull, which is within the stationary half of the injection mold. That is, a separate moving piece of machinery is needed to create the semi-spherical indentation or aperture. This method of manufacture is undesirable in that significant capital expenditure is incurred in purchasing and maintaining these mechanisms. Moreover, the cost of the molded parts is increased due to the longer cycle times involved in cooling a mold having a complex mechanism.

There has, therefore, been a desire to have a toggle dispensing closure which can be manufactured in one injection molding step and overcome the downfalls of the previously described method.

There has also been a desire to have a toggle dispensing closure which can be manufactured using injection molding but without the use of a complex mechanism.

There has also been a further desire to have such a closure which will not easily break or scratch when removed from the mold.

There has also been a desire to have such a closure where the toggle is securely retained onto the cap.

SUMMARY OF TIE INVENTION

In accordance with the present invention there is provided an injection molded toggle dispensing closure for a package for dispensing a product. The dispensing closure includes a cap formed from a housing. The housing has a top wall and a peripheral wall surrounding and attached to the top wall so as to form a cavity. The top wall includes a lower recessed portion surrounded by an edge wall. The lower recessed portion has an aperture extending therethrough into the cavity. The edge wall has two opposing slots extending into the cavity. The slots extend upwardly from the recessed lower portion along the edge wall. The closure further includes a toggle. The toggle has an upper wall and opposing front and back walls and opposing side walls all of which surround and are attached to the upper wall. The side walls each have an outwardly extending tab which is inserted into the opposing slots on the edge wall so as to retain the toggle onto the cap, thereby allowing the toggle to pivot around the slots. The front wall has a dispensing opening which communicates with the aperture on the recessed lower portion so as to dispense the product.

BRIEF DESCRIPTION OF THE DRAWINGS

While the specification concludes with claims particularly pointing out and distinctly claiming the subject invention, it is believed the same will be better understood from the following description taken in conjunction with the accompanying drawings in which:

DETAILED DESCRIPTION OF THE INVENTION

Figure 1A:
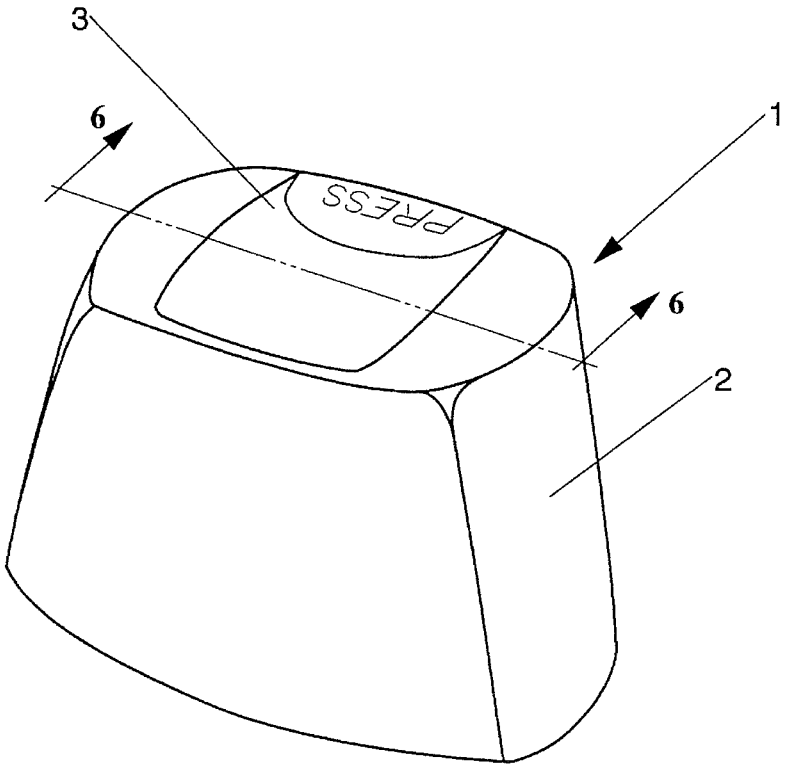
FIG. 1A is a perspective view of a toggle dispensing closure in the closed position made in accordance with the present invention.
Figure 1B:
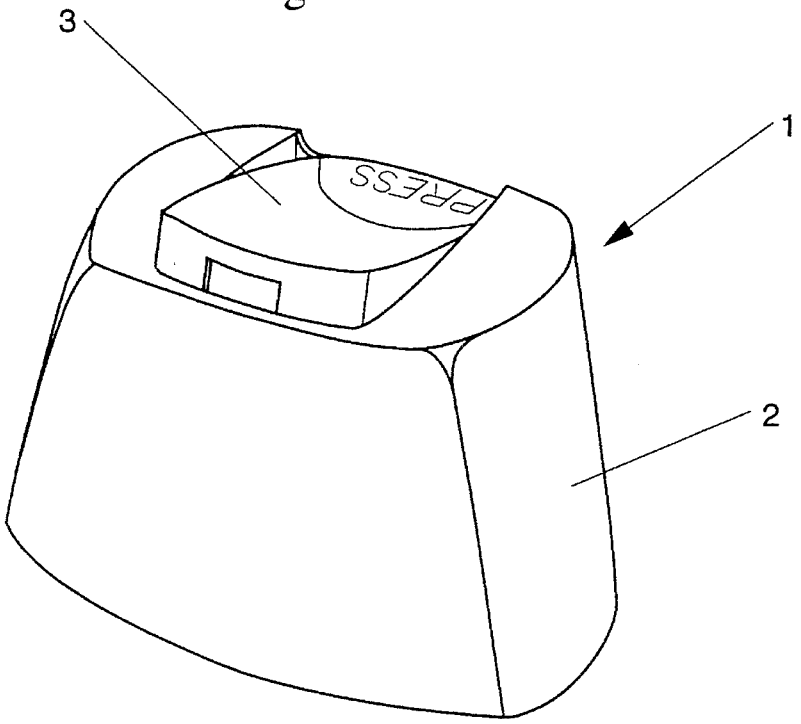
FIG. 1B is a view similar to that of FIG. 1A but showing the closure in the open position.

Referring now to the drawings in detail wherein like numerals indicate the same element throughout the views there is shown in FIGS. 1A and 1B an injection molded toggle dispensing closure 1 made in accordance with the present invention. Closure 1 is formed from a cap 2 and a toggle 3. Toggle 3 pivots between a closed position shown in FIG. 1A and an open position shown in FIG. 1B. The closure is adapted to be attached to a package for dispensing a product, preferably a liquid product.

Figure 2:
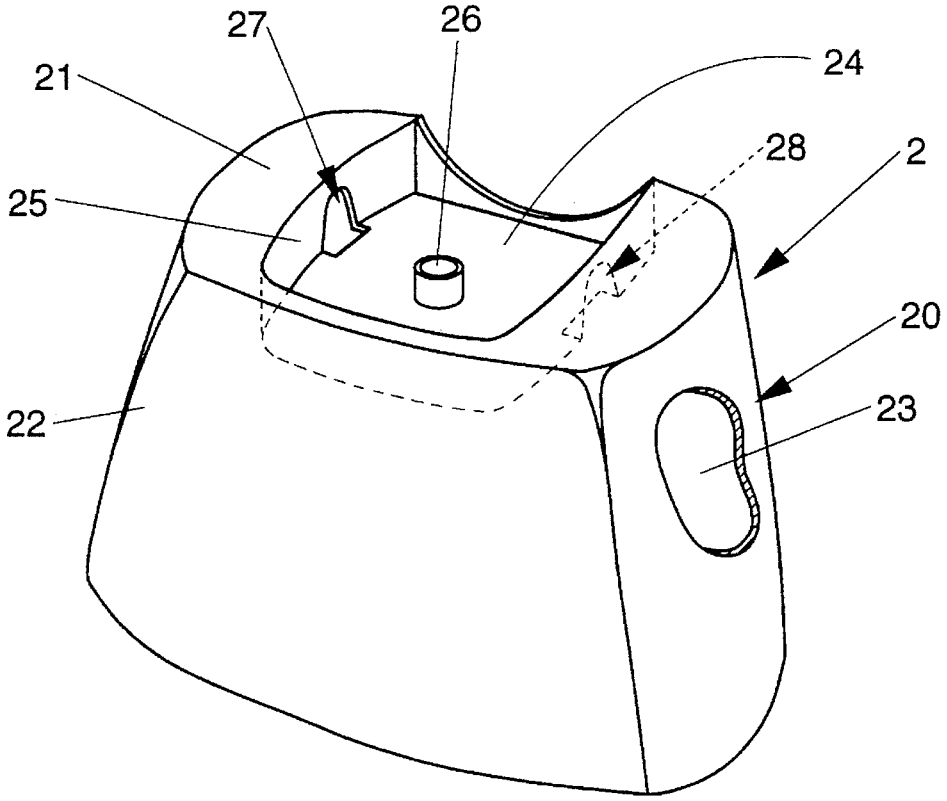
FIG. 2 is a perspective view of the cap shown in FIG. 1A.
Figure 6:
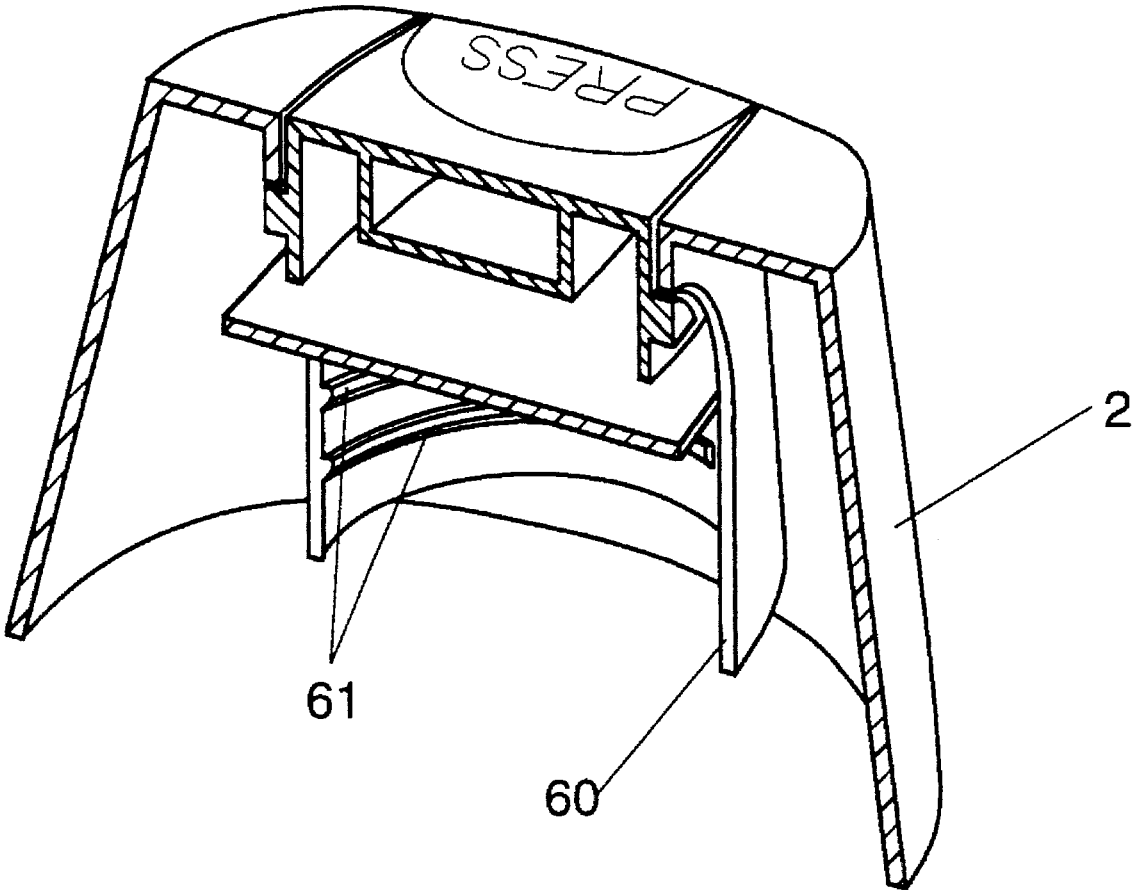
FIG. 6 is a cross-section of FIG. 1A taken along line 6—6.

Cap 2 of closure 1 can best be described by referring to FIG. 2. As seen from that figure cap 2 comprises a housing 20. The housing 20 has a top wall 21 and a peripheral wall 22. Peripheral wall 22 surrounds and is attached to top wall 21 so as to form cavity 23. Top wall 21 includes a lower recessed portion 24. Recessed portion 24 is at least partially surrounded by an edge wall 25. Recessed portion 24 includes an aperture 26 disposed therein which, as will be discussed later, is used in dispensing the product. Edge wall 25 has a pair of substantially opposing slots 27 and 28 (not shown) which extend into cavity 23. Slots 27 and 28 extend upwardly from recessed portion 24 along the edge wall 25. While features 27 and 28 are described herein as slots, they are simply apertures which extend into the cavity 23 and can take on numerous shapes. Preferably the slots 27 and 28 have a uniform width or a width which continuously decreases in size the further the slot extends away from the recessed portion 24 so that the cap is undamaged when it is removed from the cavity of an injection mold, Lastly, cap 2 preferably includes a means or a device for attaching itself to a bottle, tube or other package. One example of this is shown in FIG. 6. As seen from that Figure, cap 2 is provided with cylindrical shaft 60 having internal threads 61. Threads 61 are designed to thread onto a package having corresponding external threads. Other suitable means known in the art, such as a snap-on arrangement, can be used to attach the cap to a package.

Figure 3:
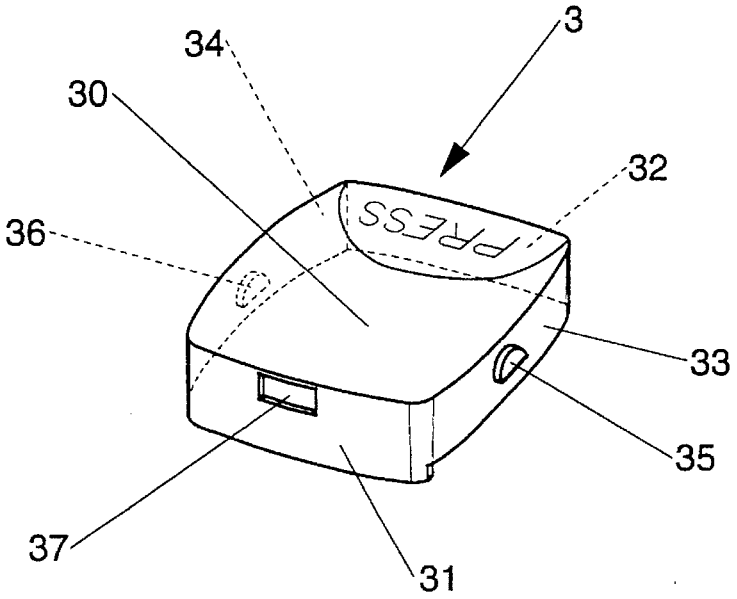
FIG. 3 is a perspective view of the toggle shown in FIG. 1B.

The toggle 3 of closure 1 can best be described by referring to FIG. 3. As seen from that figure toggle 3 is formed from an upper wall 30. Toggle 3 also includes opposing front and back walls, 31 and 32 respectively, and opposing side walls 33 and 34. While the toggle shown in FIG. 3 is rectangular it could be circular or oval with walls 31-34 forming, in effect, an annular wall. Side walls 33 and 34 each have an outwardly extending tab 35 and 36 extending therefrom. Tabs 35 and 36 are inserted into slots 27 and 28, preferably by a snap-fit arrangement, so as to attach the toggle to the cap so that it appears as it does in FIG. 1A. Tabs 35 and 36 extend into slots 27 and 28 in such a way so as to allow the toggle 3 to pivot around the slots 27 and 28 as shown in FIG. 1B. Slots 27 and 28 preferably have an arched shape, as shown in FIG. 2, and it is preferred that tabs 35 and 36 have a semi-cylindrical shape with the curved portion making contact with the upper surface of the slots. Toggle 3 further includes a dispensing opening 37 which communicates with aperture 26 on cap 2, so as to provide a way to dispense a product from the closure once it is attached to a package.

Figure 4:
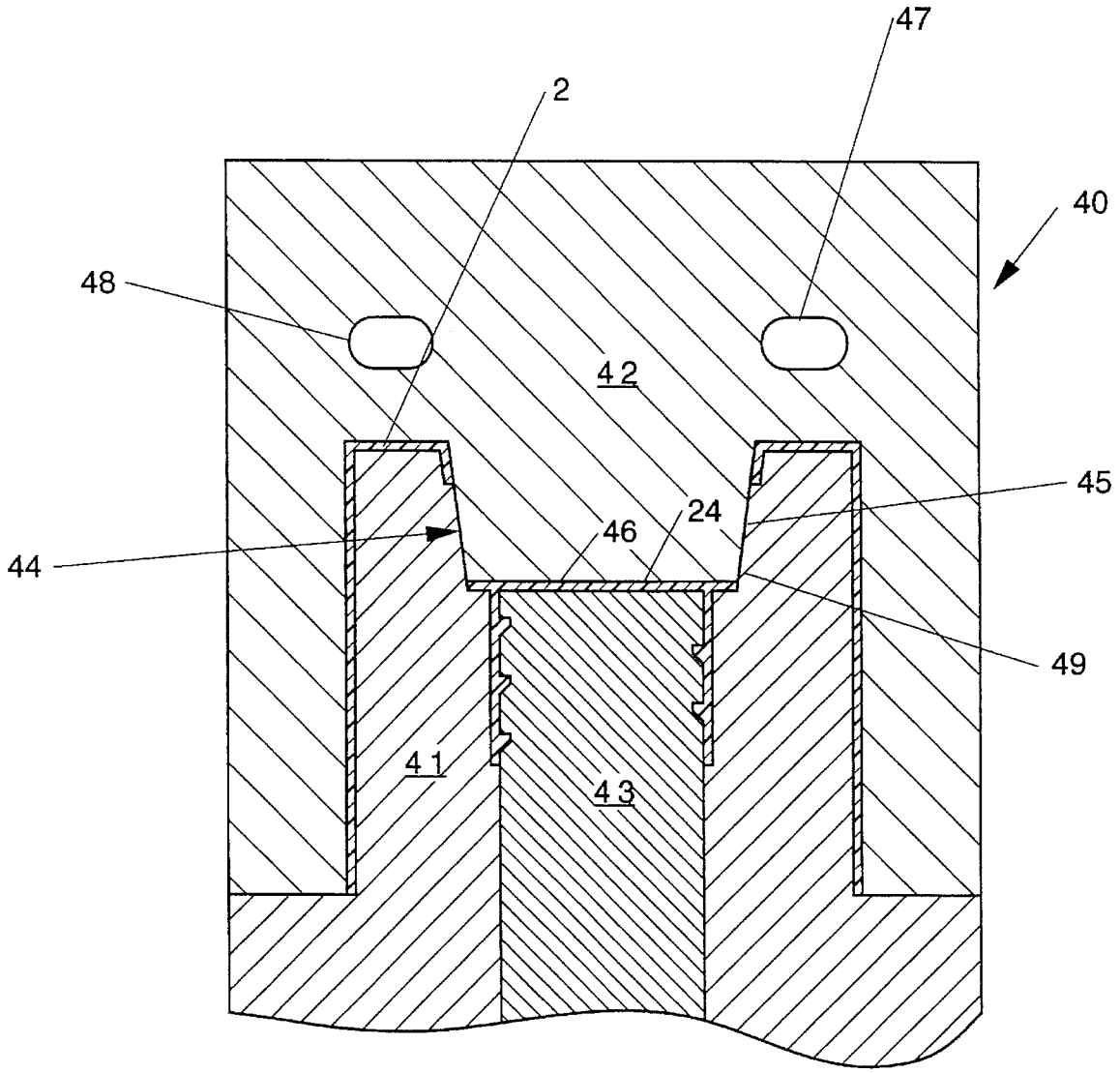
FIG. 4 is a cross-sectional view of a mold used to make the cap of FIG. 1.
Figure 5:
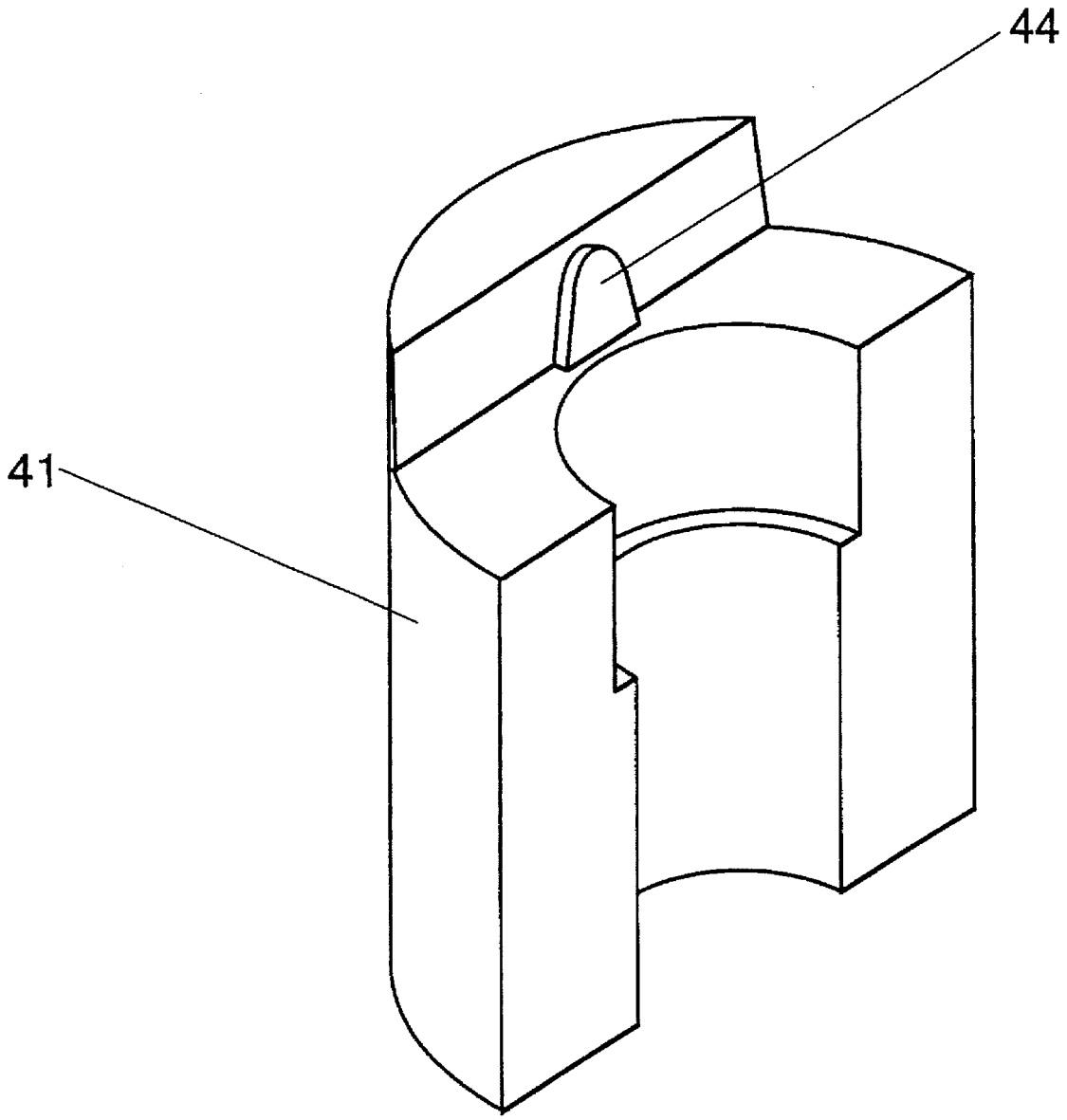
FIG. 5 is a partial perspective view of the core of the mold of FIG. 4.

How the cap 2 is molded so as to create the slots 27 and 28 can best be described by referring to FIG. 4. FIG. 4 is a cross-section of an injection mold 40 for producing cap 2. Mold 40 comprises core 41, cavity 42 and core pin 43. During the molding cycle, the routine of closing the mold causes cavity 42 to contact core 41 at areas 44 and 45 to create slots 27 and 28. The technique is referred to in the art as by-passing shutoff and areas 44 and 45 are referred to in the art as by-pass shutoffs. By pass-shutoffs 44 and 45 enable the creation of slots 27 and 28 without the use of a complex mechanism such as a core pull. Because the slots extend upwardly from the recessed area 24, there are no undercuts on the cap and the cap can be easily removed from the mold. That is if the core 41 of mold 40 did not touch the cavity near the recessed portion such as at point 49, when the cap is removed from the cavity it would tip or tear at that point which could alter the functionality and/or the aesthetics of the closure. It is this same principle that the slots should have a continuous width or continuously decrease in width as they move farther away from the recessed area 24. As seen from FIG. 5, by-pass shut off 44 projects outwardly so that it contacts cavity 42.

By referring back to FIG. 4, the design of the mold allows the gate, or point at where the plastic is injected into the mold, to be hidden. Gates are often unsightly and reduce the aesthetics of the package. Because the complex mechanism has been removed from the mold, cooling of the mold can be optimized through the use of water channels 47 and 48. Water channels can be placed on the cavity at this position because they do not have to be diverted in order to avoid a complex mechanism. With this mold the gate can be placed near point 46. This causes the gate to appear on recessed portion 24 so that it is hidden by the toggle 3. This improves the aesthetics of the package.

While particular embodiments of the present invention have been illustrated and described herein it will be obvious to those skilled in the art that various changes and modifications can be made without departing from the spirit and scope of the present invention and it is intended to cover in the appended claims all such modifications that are within the scope of this invention.

What is claimed is:

1. An injection molded toggle dispensing closure for a package for dispensing a product, said toggle dispensing closure comprising:

(a) a cap comprising a housing, said housing having a top wall and a peripheral wall surrounding and attached to said top wall so as to define a cavity, said top wall including a lower recessed portion surrounded at least partially by an edge wall, said lower recessed portion defining a first plane and having an aperture therein, said edge wall defining a second plane substantially perpendicular to said first plane, said edge wall having two substantially opposing slots extending through said edge wall into said cavity and through said lower recessed portion into said cavity, said slots thereby penetrating both first and second planes, said slots taper from a widest portion at said recessed lower portion to a narrowest portion substantially adjacent to said top wall; and (b) a toggle comprising an upper wall, said toggle further including opposing front and back walls and opposing side walls all of which surround and are attached to said upper wall, said side walls each having an outwardly extending tab, said tabs are inserted into said substantially opposing slots on said edge wall so as to retain said toggle onto said cap, thereby allowing said toggle to pivot around said slots, said front wall including a dispensing opening which communicates with said aperture on said recessed lower portion so as to dispense said product.

2. The closure according to claim 1 further including means for attachment to a package.

3. The closure according to claim 2 wherein said means for attachment to a package comprises a cylindrical shaft extending down from said top wall into said cavity, said shaft having internal threads disposed thereon.

4. The closure according to claim 1 wherein said slots have an arched shape and said tabs have a semi-cylindrical shape having the cylindrical portion facing away from said recessed portion.

5. The closure according to claim 1 wherein said slots have a width which only decreases as it extends away from said recessed portion.

6. The closure according to claim 1 wherein a gate for injection molding of said closure is disposed in said recessed area.

* * * * *